United States Patent [19]

Swenson et al.

[11] Patent Number: 4,720,041

[45] Date of Patent: Jan. 19, 1988

[54] TELESCOPING COIN BOX FOR A COIN-OPERATED MACHINE

[75] Inventors: Ronald D. Swenson, Roanoke, Va.; James N. Seaborn, Kitchner, Canada

[73] Assignee: Medeco Security Locks, Inc., Salem, Va.

[21] Appl. No.: 919,692

[22] Filed: Oct. 16, 1986

[51] Int. Cl.[4] ..... G07B 15/00

[52] U.S. Cl. ..... 232/16; 232/7

[58] Field of Search ..... 232/10, 15, 16, 7

[56] References Cited

U.S. PATENT DOCUMENTS

| | | | |
|---|---|---|---|
| 2,815,166 | 12/1957 | Sollenberger | 232/16 |
| 2,964,237 | 12/1960 | Henderson | 232/16 |
| 3,807,628 | 4/1974 | Bock | 232/16 |
| 4,177,889 | 12/1979 | Adams et al. | 232/16 X |

*Primary Examiner*—Robert W. Gibson, Jr.

*Attorney, Agent, or Firm*—Bernard, Rothwell & Brown

[57] ABSTRACT

A telescoping coin vault box for a coin-operated machine defined by telescoping cylindrical first and second box portions having a slot for admitting coins into the coin box. The box portions are telescopically slidable relative to each other between extended and contracted positions to fit different size coin vaults.

4 Claims, 5 Drawing Figures

FIG. 2B
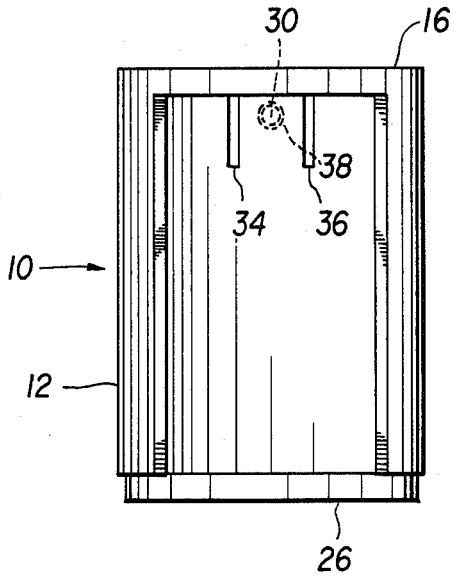
FIG. 3
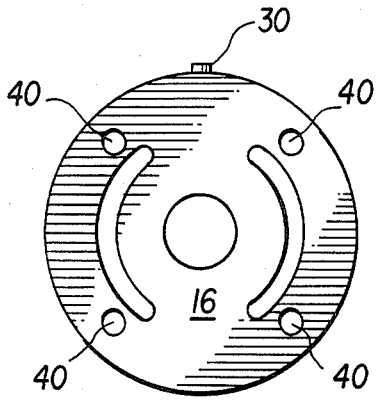
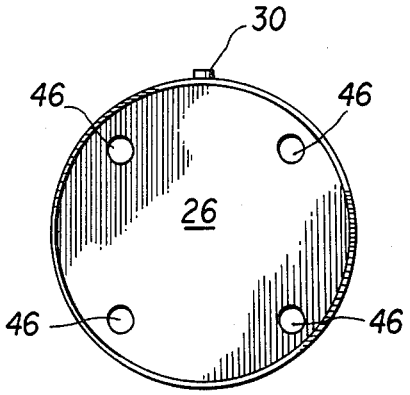
FIG. 4

TELESCOPING COIN BOX FOR A COIN-OPERATED MACHINE

BACKGROUND OF THE INVENTION

1. Field of the Invention

The present invention relates to a coin box for a coin-operated machine.

2. Description of the Background Art

A large number of coin-operated machines are known, such as coin-operated laundry machines in laundromats.

Coin-operated machines are actuated by insertion therein of the proper amount of money in the form of coins. The inserted coins are stored in a coin box locked within a coin vault in the machine for later retrieval by a person having access, such as by a key, to the coin box.

Some coin-operated laundry machines require coin boxes of different sizes. Heretofore this required the manufacture of different sized coin boxes to fit the varying machines. A savings could be realized if a single coin box could be manufactured which was capable of fitting coin-operated machines requiring different size coin boxes.

SUMMARY OF THE INVENTION

In accordance with the present invention, a telescoping coin vault box for a coin-operated machine comprises a first box portion including a generally cylindrical wall portion having an open end and a closed end, the cylindrical wall portion having an open slot extending from the vicinity of the closed end to the open end of the wall portion. The coin box further includes a second box portion including a second generally cylindrical wall portion having an open end and a closed end, the second cylindrical wall portion having an open slot extending from the vicinity of the closed end to the open end of the second cylindrical wall portion. The open ends of the respective box portions telescopically receive each other with the slot of the first and second box portions in alignment, to form a coin box defined by the cylindrical wall portions and the closed ends of the first and second box portions with the open slots in alignment to admit coins into the box. The first and second box portions are telescopically slidable relative to each other between an extended position wherein the closed ends are a first distance apart with the coin box being capable of holding a first volume of coins, and a contracted position wherein the closed ends are a lesser distance apart with the coin box being capable of holding a smaller volume of coins. The cylindrical wall portions of the first and second box portions are selectively lockable to lock the first and second box portions together in the extended and contracted positions. One of the closed ends is connectable to a lock for selectively locking the coin box within a coin vault of a coin-operated machine.

BRIEF DESCRIPTION OF THE DRAWINGS

FIG. 2B is an elevational view of an assembled coin box according to the invention in a contracted position.

FIG. 3 is an elevational view of one end of a coin box according to the invention for connection with a coin box lock.

FIG. 4 is an elevational view of another end of a coin box according to the invention including openings for aligning the end with alignment portions within a coin vault of a coin-operated machine.

DETAILED DESCRIPTION OF THE PREFERRED EMBODIMENT

Figure 1:
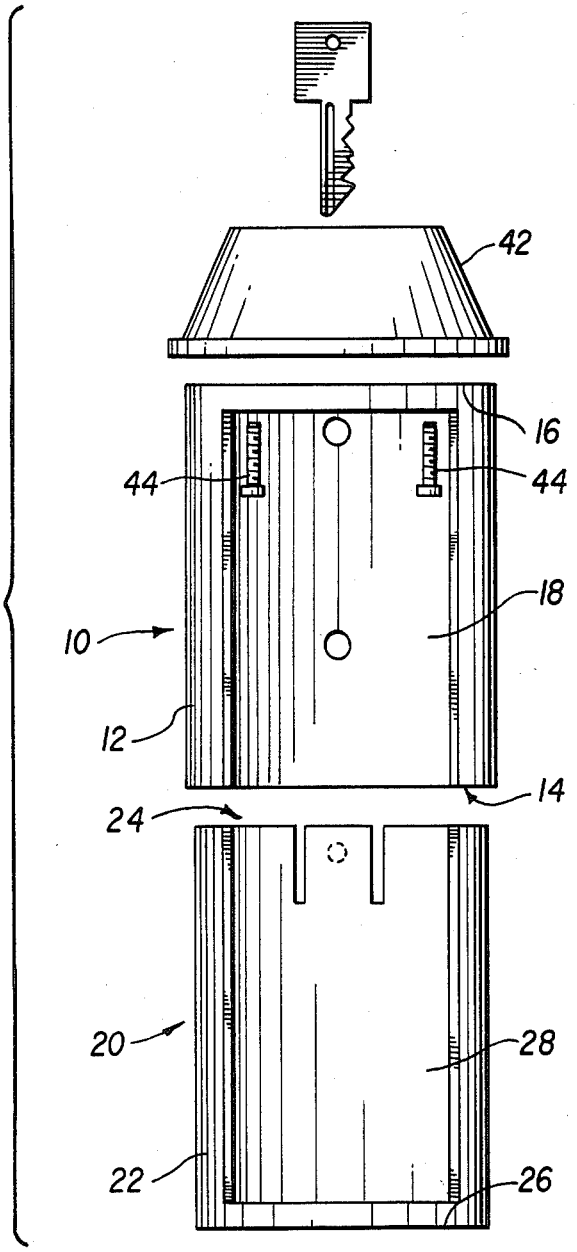
FIG. 1 is an exploded, elevational view, partly schematic, of a coin box according to the invention with a lock member for locking the coin box in a coin-operated machine.

With reference to FIG. 1, a telescoping coin vault box for a coin-operated machine includes a first box portion 10 having a generally cylindrical wall portion 12. The cylindrical wall portion 12 includes an open end 14 and a closed end 16. The cylindrical wall portion 12 includes an open slot 18 extending between a position approximate the closed end 16 and the open end 14 of cylindrical wall portion 12.

The telescoping coin vault box of the invention further includes a second box portion 20 including a second generally cylindrical wall portion 22. The second cylindrical wall portion 22 includes an open end 24 and a closed end 26 with an open slot 28 extending between a position approximate the closed end 26 to the open end 24.

The open end 24 of the second box portion 20 is telescopically received within the open end 14 of the first box portion 10 with slots 18 and 28 of respective first and second box portions in alignment. See FIGS. 2A and 2B. The telescopically mated first and second box portions 10 and 20 form a cash box defined by cylindrical wall portions 12, 22 and closed ends 16, 26 with slots 18 and 28 in alignment to admit coins into the coin vault box.

Figure 2A:
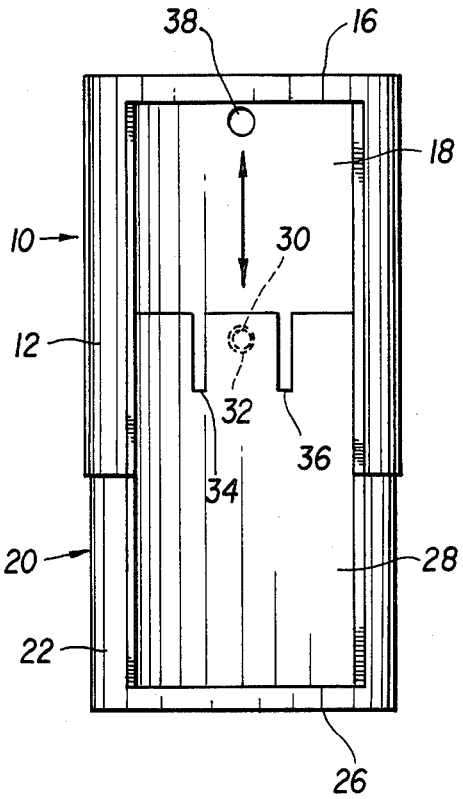
FIG. 2A is an elevational view of an assembled coin box according to the invention in an extended position.

First and second box portions 10 and 20 are telescopically slidable relative to each other between an extended position shown in FIG. 2A wherein ends 16 and 26 are a first distance apart (e.g., $6\frac{1}{8}$ inches) with the coin box being capable of holding a first volume of coins, and a contracted position shown in FIG. 2B wherein ends 16 and 26 are a lesser distance apart (e.g., $4\frac{1}{8}$ inches) with the coin box being capable of holding a smaller volume of coins.

For selectively locking together the cylindrical wall portions 12 and 22 in the extended position, cylindrical wall portion 22 is provided with an outwardly projecting tab 30 which fits within a complementary keeper opening 32 within cylindrical wall portion 12. Advantageously, the first and second box portions 10 and 20 are molded of a stiff but resilient plastic material. Slots 34 and 36 are provided adjacent tab 30, thus providing tab 30 with spring-biasing due to the resiliency of the plastic material, for selective locking tab 30 within keeper opening 32.

A second keeper opening 38 is provided in cylindrical wall portion 12 for selectively locking together first and second cylindrical wall portions 12 and 20 when telescoped to the contracted position shown in FIG. 2B.

End 16 of box portion 10 includes a plurality of openings 40 (four shown in FIG. 3) for connecting the coin box to a lock 42 (shown schematically in FIG. 1). Lock 42 selectively locks the cash box within a coin vault of a coin-operated machine. Suitable connecting means, such as bolts 44 (two shown in FIG. 1) connect lock 42 to end 16 through openings 40.

A coin box according to the invention fits into standard sized coin box housings of coin-operated laundry machines such as are manufactured by Whirlpool and other manufacturers. A coin box according to the invention fits within a corresponding coin vault of suitable machines, the coin vault generally being manufactured of hardened steel, or other defeat-resistant materials.

End 26 of box portion 22 includes openings 46 for mating with corresponding projections within a coin vault of a coin-operated machine for aligning the coin box with the coin box slot properly positioned for receiving coins.

A coin box according to the present invention can accommodate machines having coin vaults of different lengths, allowing the manufacture of a single coin box useful in a variety of machines.

Since many modifications, variations and changes in detail may be made to the described embodiments, it is intended that all matter in the foregoing description and shown in the accompanying drawings be interpreted as illustrative and not in a limiting sense.

What is claimed is:

1. A telescoping coin vault box for a coin-operated machine, comprising:

(a) a first box portion including a first generally cylindrical wall portion having an open end and a closed end, the cylindrical wall portion having an open slot extending from approximate said closed end to the open end of the cylindrical wall portion;

(b) a second box portion including a second generally cylindrical wall portion having an open end and a closed end, the second cylindrical wall portion having an open slot extending from aproximate the closed end of the second cylindrical wall portion to the open end of the second cylindrical wall portion, the open end of the first box portion telescopically receiving the open end of the second box portion with the slots of the first and second box portions in alignment to form a telescoping coin vault box defined by the cylindrical wall portions and the closed ends of the first and second box portions with the respective slots in alignment for admitting coins into the coin vault box, the first and second box portions being telescopically slidable relative to each other between an extended position wherein said closed ends are a first distance apart with the coin box being capable of holding a first volume of coins, and a contracted position wherein said closed ends are a lesser distance apart with the coin box being capable of holding a smaller volume of coins;

(c) means cooperating between the first and second box portions for selectively locking together the respective cylindrical wall portions of the first and second box portions in said extended position; and (d) one of said closed ends including means for connecting that closed end with a lock means for selectively locking the coin box within a coin vault of a coin-operated machine.

2. The coin vault box of claim 1 wherein the means cooperating between the first and second box portions for selectively locking together said cylinder wall portions comprises a spring-biased tab on one cylindrical wall portion which mates with and locks within a corresponding opening of the other of the cylindrical wall portions at said extended position.

3. The coin vault box of claim 2 wherein said other of the cylindrical wall portions includes a second opening for mating with said spring-biased tab and locking the cylindrical wall portions together at said contracted position.

4. The coin vault box of claim 1 wherein the other of said closed ends opposite the end having the lock-connecting means includes a plurality of openings for mating with and aligning the other of said closed ends with corresponding alignment projections within a coin vault of a coin-operated machine.

* * * * *